US011844968B2

(12) United States Patent
Leuschner et al.

(10) Patent No.: US 11,844,968 B2
(45) **Date of Patent: *Dec. 19, 2023**

(54) DATA COMMUNICATION AND DISPLAYS FOR BREATHING APPARATUS FACEPIECES AND PRESSURE REGULATORS

(71) Applicant: MSA TECHNOLOGY, LLC, Cranberry Township, PA (US)

(72) Inventors: Carsten Leuschner, Berlin (DE); Klaus Schmidtke, Berlin (DE); Marco Tekelenburg, Zelienople, PA (US); Michael Horn, Berlin (DE); Detlef Kielow, Berlin (DE); Thomas Kuba, Schulzendorf (DE)

(73) Assignee: MSA Technology, LLC, Cranberry Township, PA (US)

( * ) Notice: Subject to any disclaimer, the term of this patent is extended or adjusted under 35 U.S.C. 154(b) by 1030 days.

This patent is subject to a terminal disclaimer.

(21) Appl. No.: 16/724,538

(22) Filed: Dec. 23, 2019

(65) Prior Publication Data

US 2020/0121963 A1 Apr. 23, 2020

Related U.S. Application Data

(60) Continuation of application No. 14/820,872, filed on Aug. 7, 2015, now Pat. No. 10,512,797, which is a (Continued)

(51) Int. Cl.
*A62B 9/00* (2006.01)
*A62B 7/02* (2006.01)
(Continued)

(52) U.S. Cl.
CPC ..... *A62B 9/006* (2013.01); *A62B 7/02* (2013.01); *A62B 18/006* (2013.01); *A62B 18/02* (2013.01);
(Continued)

(58) Field of Classification Search
CPC ..... A62B 9/006; A62B 9/022; A62B 18/00; A62B 18/02; A62B 18/025; A62B 18/08;
(Continued)

(56) References Cited

U.S. PATENT DOCUMENTS 4,821,767 A 4/1989 Jackson
5,016,627 A 5/1991 Dahrendorf
(Continued)

FOREIGN PATENT DOCUMENTS

GB 2380044 A 3/2003
WO WO2004018013 A2 3/2004
WO WO2012003132 1/2012

OTHER PUBLICATIONS

MSA Bulletin entitled Nightfighter Heads-Up Display System, Aug. 2002.
MSA Bulletin entitled The alphaHUD Head-Up-Display, Jan. 2008.

*Primary Examiner* — Joseph D. Boecker
(74) *Attorney, Agent, or Firm* — BARTONY & ASSOCIATES LLC

(57) ABSTRACT

A system includes a pressure regulator including a housing, an inlet for connection to a pressurized gas comprising oxygen, and at least one energy transfer element. The system further includes a respiration facepiece including at least one seal system to form a sealing engagement with the face of a user to encompass the nose and mouth of the user, thereby creating a volume of sealing engagement between the respiration facepiece and the user, an opening into the volume of sealing engagement of the respiration facepiece in communicative connection with an interface for removable attachment of the pressure regulator to the respiration facepiece, and an inspiration port in fluid connection with the interface and in fluid connection with the volume of sealing engagement. The pressure regulator interface includes at least one cooperating energy transfer element such that
(Continued)

energy can be transferred between the at least one energy transfer element and the at least one cooperating energy transfer element to transfer at least one of data or power into the volume of sealing engagement.

19 Claims, 13 Drawing Sheets

Related U.S. Application Data division of application No. 13/167,778, filed on Jun. 24, 2011, now Pat. No. 9,108,073.

(60) Provisional application No. 61/360,936, filed on Jul. 2, 2010.

(51) Int. Cl.

| | |
|---|---|
| ***A62B 18/02*** | (2006.01) |
| ***A62B 18/08*** | (2006.01) |
| ***A62B 18/00*** | (2006.01) |
| *G08B 21/18* | (2006.01) |

(52) U.S. Cl.
CPC ..... *A62B 18/08* (2013.01); *A62B 18/082* (2013.01); *G08B 21/182* (2013.01)

(58) Field of Classification Search
CPC .. A62B 18/10; A62B 7/02; A62B 7/14; B63C 11/2227; B63C 2011/121
See application file for complete search history.

(56) References Cited

U.S. PATENT DOCUMENTS

| | | | | |
|---|---|---|---|---|
| 5,097,826 | A | 3/1992 | Gray | |
| 5,764,203 | A | 6/1998 | Holmlund | |
| 5,913,307 | A | 6/1999 | Taied | |
| 6,032,664 | A * | 3/2000 | Gray | A62B 9/00 128/201.27 |
| 6,118,382 | A | 9/2000 | Hibbs | |
| 6,899,101 | B2 | 5/2005 | Haston | |
| 6,966,316 | B2 | 11/2005 | Lowry | |
| 7,477,207 | B2 | 1/2009 | Estep | |
| 7,571,726 | B2 | 8/2009 | Parker | |
| 8,091,422 | B2 | 1/2012 | Felske | |
| 8,316,850 | B2 | 11/2012 | Grilliot | |
| 2003/0234018 | A1 * | 12/2003 | Haston | B63C 11/14 128/201.27 |
| 2008/0023002 | A1 | 1/2008 | Guelzow | |
| 2008/0185001 | A1 * | 8/2008 | McWilliams | G02B 27/017 128/204.21 |
| 2010/0308991 | A1 | 12/2010 | Adams | |
| 2012/0132200 | A1 | 5/2012 | Chambers | |

* cited by examiner

DATA COMMUNICATION AND DISPLAYS FOR BREATHING APPARATUS FACEPIECES AND PRESSURE REGULATORS

CROSS-REFERENCE TO RELATED APPLICATION

This application is a continuation application of U.S. patent application Ser. No. 14/820,872, filed Aug. 7, 2015, which is a divisional patent application of U.S. patent Ser. No. 13/167,778, filed Jun. 24, 2011, now U.S. Pat. No. 9,108,073, issued Aug. 18, 2015, which claims benefit of U.S. Provisional Patent Application Ser. No. 61/360,936, filed Jul. 2, 2010, the disclosures of which are incorporated herein by reference.

BACKGROUND

The following information is provided to assist the reader in understanding the devices, systems and/or methods disclosed below and the environment in which such devices, systems and/or methods will typically be used. The terms used herein are not intended to be limited to any particular narrow interpretation unless clearly stated otherwise in this document. References set forth herein may facilitate understanding of the devices, systems and/or methods or the background. The disclosure of all references cited herein are incorporated by reference.

A supplied-air respirator such as self-contained breathing apparatus (SCBA) permits a person to breath in hazardous environments such as fires and confined spaces where breathing would be difficult or impossible without mechanical aid. A supplied-air respirator may, for example, include a full facepiece, a harness and carrier assembly, a gas cylinder containing high pressure compressed air (or other oxygen containing gas) for breathing and at least one, and more typically two, pressure regulators. The first or first-stage regulator is typically mounted near the air cylinder and functions to reduce the relatively high pressure of the compressed air from the air cylinder to above atmospheric pressure. The air cylinder typically contains air (or other breathable gas) under a relatively high pressure of, for example, 2200 psi to 4500 psi. The first stage regulator may, for example, reduce the pressure to about 80-100 psi. The second or second-stage regulator is typically mounted on the facepiece and functions to adjust the flow of air to meet the respiratory needs of the user. Respiration-controlled regulator assemblies are disclosed, for example, in U.S. Pat. Nos. 4,821,767 and 5,016,627.

The facepiece or face mask, which is sealed to the face of the user, typically includes a lens through which the user can view the surrounding environment. The facepiece also includes an interface or mount for fluid connection with the second-stage regulator through which inspired air passes into the face mask and an exhalation port through with expired air passes out of the mask. In some facepieces, a single port is used for both inspired and expired air. In other facepieces, separate ports are used. The user's respiration controls a valve system (for example, including an inhalation valve and an exhalation valve) to control delivery of pressurized air via the second-stage regulator. Often, it is desirable to maintain a slight positive pressure within the facepiece relative to ambient pressure. Facepieces for supplied-air respirators in which a positive pressure is maintained within the facepiece are often referred to as pressure demand facepieces, while other facepieces for supplied-air respirators are often referred to as demand facepieces.

It is often desirable to provide information to the user of a breathing apparatus, including, for example, data on the status of the air supply, power supply and/or other systems of the breathing apparatus, information on other users in the vicinity of the user, evacuation alerts and/or other information. Informational displays have been provided to users of a breathing apparatus in a number of manners. For example, a display may be provided in the vicinity of the second stage regulator. A display may alternatively be provided on an outer portion of the lens. In the case of displays exterior to a facepiece of a breathing apparatus, smoke or other environmental conditions could obscure the user's vision of the display unless it is located very close to the lens of the facepiece. Moreover, harsh environmental conditions can adversely affect the operation the display. Also, care must be taken in the case of positioning a display in the vicinity of the facepiece lens not to overly obstruct the field of view of the user.

Providing a display within the interior of the facepiece can eliminate one or more of the adverse effects of the surrounding environment on the display, but can present other problems with, for example, adequately sealing the passage of electronics through the facepiece to communicate with the display. Although use of a powered display within the facepiece that communicates wirelessly with electronics external to the facepiece can eliminate the problems associated with passing electric wires and/or electronics through the facepiece, a dedicated power supply within the facepiece is still required to power the display. Moreover, the display and associated electronics within the facepiece can increase manufacturing costs as well as maintenance time and costs.

Whether a display is provided internal to the facepiece or attached externally thereto, currently available displays can negatively impact the weight of the facepiece, the center of gravity of the facepiece, the field of view of the user, the cost of the facepiece and/or other aspects of the facepiece.

SUMMARY

In one aspect, a respiration system includes a pressure regulator including a housing, an inlet for connection to a pressurized gas comprising oxygen, and a first data communication system, and a respiration facepiece including an interface to which the pressure regulator is removably attachable, at least one seal system to form a sealing engagement with the face of a user to encompass the nose and mouth of a wearer; an inspiration port in fluid connection with the pressure regulator interface and in fluid connection with the interior of the facepiece and at least one display within a volume of sealing engagement with the face of the user that is within the field of view of the user. The pressure regulator interface includes a second data communication system to receive data from the first data communication system to control the at least one display. A sealing attachment may, for example, be formed between the pressure regulator and the interface of the facepiece.

In a number of embodiments, the first data communication system includes a least one light source and the second data communication system includes at least one light guide. The first data communication system may, for example, include a plurality of light sources at spaced positions, and the second data communication system may, for example, include a plurality of light guides. Each of the plurality of light sources may, for example, be aligned to transmit light to a first end of one of the plurality of light guides when the pressure regulator is attached to the interface of the facepiece. In a number of embodiments, each of the plurality of light guides includes a translucent polymeric tube.

The at least one display may, for example, include a second end of at least one of the plurality of light guides. The facepiece may further include at least a second display including a second end of at least one other of the plurality of light guides.

The first data communication system may, for example, include at least one data transfer element, and the second data communication system may, for example, include at least one cooperating data transfer element. The sealing attachment formed between the pressure regulator and the interface of the facepiece may, for example, provide a seal between the environment and the first data transfer element and the second data transfer element.

In another aspect, a pressure regulator for use with a facepiece, which includes an interface for removable attachment of the pressure regulator thereto, at least a first display within the facepiece, and a first data communication system within the interface that is in communicative connection with the display, includes: a housing, an inlet for connection to a pressurized gas comprising oxygen, and a second data communication system at least partially within the housing. The first data communication system of the pressure regulator is adapted to transmit data to the second data communication system of the facepiece. The pressure regulator may, for example, further include a sealing member to form a sealing engagement between the pressure regulator and an interface of the facepiece.

The first data communication system may, for example, include at least one light source. In a number of embodiments, the first data communication system includes a plurality of light sources at spaced positions.

In another aspect, a method of providing information to a user of a breathing apparatus including transmitting data to a first data communication system of a pressure regulator of the breathing apparatus and transmitting data from the first data communication system to a second data communication system of a facepiece of the breathing apparatus. In a number of embodiments, data is transmitted from the first communication system to the second data communication system via light energy.

In another aspect, a respiration facepiece for use in connection with a pressure regulator includes an interface to which the pressure regulator is removably attachable, at least one seal system to form a sealing engagement with the face of a user to encompass the nose and mouth of a wearer; an inspiration port in fluid connection with the pressure regulator interface and in fluid connection with the interior of the facepiece and at least one display within a volume of sealing engagement with the face of the user that is within the field of view of the user. The pressure regulator interface includes a data communication system to receive data from the pressure regulator to control the at least one display.

In a further aspect, a respiration system includes a pressure regulator and a respiration facepiece. The pressure regulator includes a housing, an inlet for connection to a pressurized gas including oxygen, and at least one energy transfer element. The respiration facepiece includes an interface to which the pressure regulator is removably attachable, at least one seal system to form a sealing engagement with the face of a user to encompass the nose and mouth of a wearer; an inspiration port in fluid connection with the pressure regulator interface and in fluid connection with the interior of the facepiece. The pressure regulator interface includes at least one cooperating energy transfer element such that energy can be transferred between the at least one energy transfer element and the at least one cooperating energy transfer element to transfer at least one of data or power. A sealing attachment may, for example, be formed between the pressure regulator and the interface of the facepiece. The sealing attachment formed between the pressure regulator and the interface of the facepiece may, for example, provide a seal between the environment and the first energy transfer element and the second energy transfer element.

The devices, systems and/or methods, along with the attributes and attendant advantages thereof, will best be appreciated and understood in view of the following detailed description taken in conjunction with the accompanying drawings.

DETAILED DESCRIPTION

As used herein and in the appended claims, the singular forms "a," "an", and "the" include plural references unless the content clearly dictates otherwise. Thus, for example, reference to "a port" includes a plurality of such ports and equivalents thereof known to those skilled in the art, and so forth, and reference to "the port" is a reference to one or more such ports and equivalents thereof known to those skilled in the art, and so forth.

FIGS. 1 through 6 and 8B illustrate a representative embodiment of a full facepiece or respirator face mask 10 into which a data communication system and a display for communicated data/information may be incorporated. As is clear to one skilled in the art, however, the data communications systems and displays claimed herein may be incorporated in many types of facepieces (including, for example, via retrofitting or modifying currently available facepieces). Similarly, FIGS. 1, 5, 6, 7B and 8A through 8E illustrate a representative embodiment of a pressure regulator 400 into which a data communication system may be incorporated. As is clear to one skilled in the art, however, the data communications systems claimed herein may be incorporated in many types of pressure regulators (including, for example, via retrofitting or modifying currently available pressure regulators).

Figure 1:
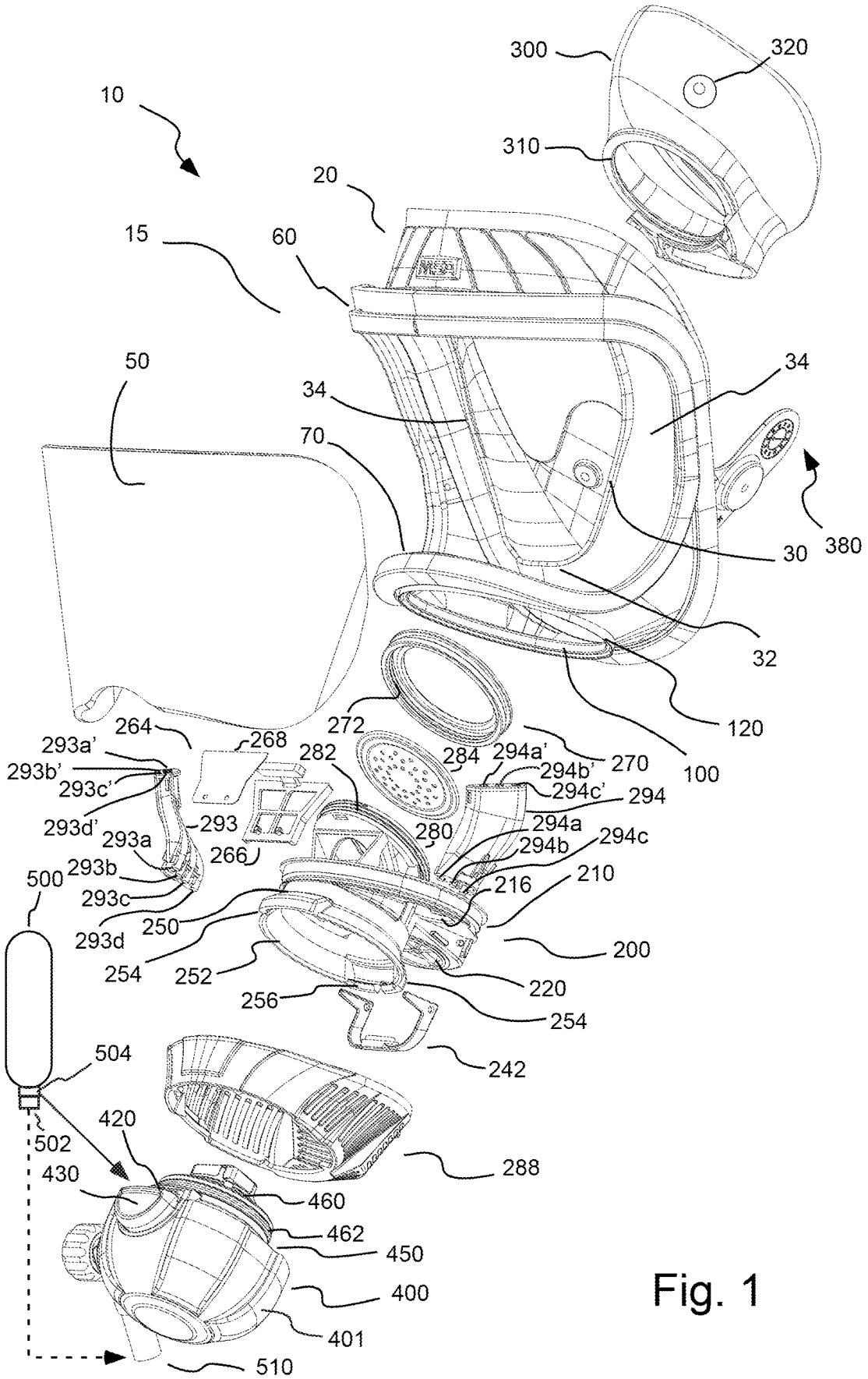
FIG. 1 illustrates an exploded or disassembled perspective view of a representative embodiment of a facepiece described herein.
Figure 2:
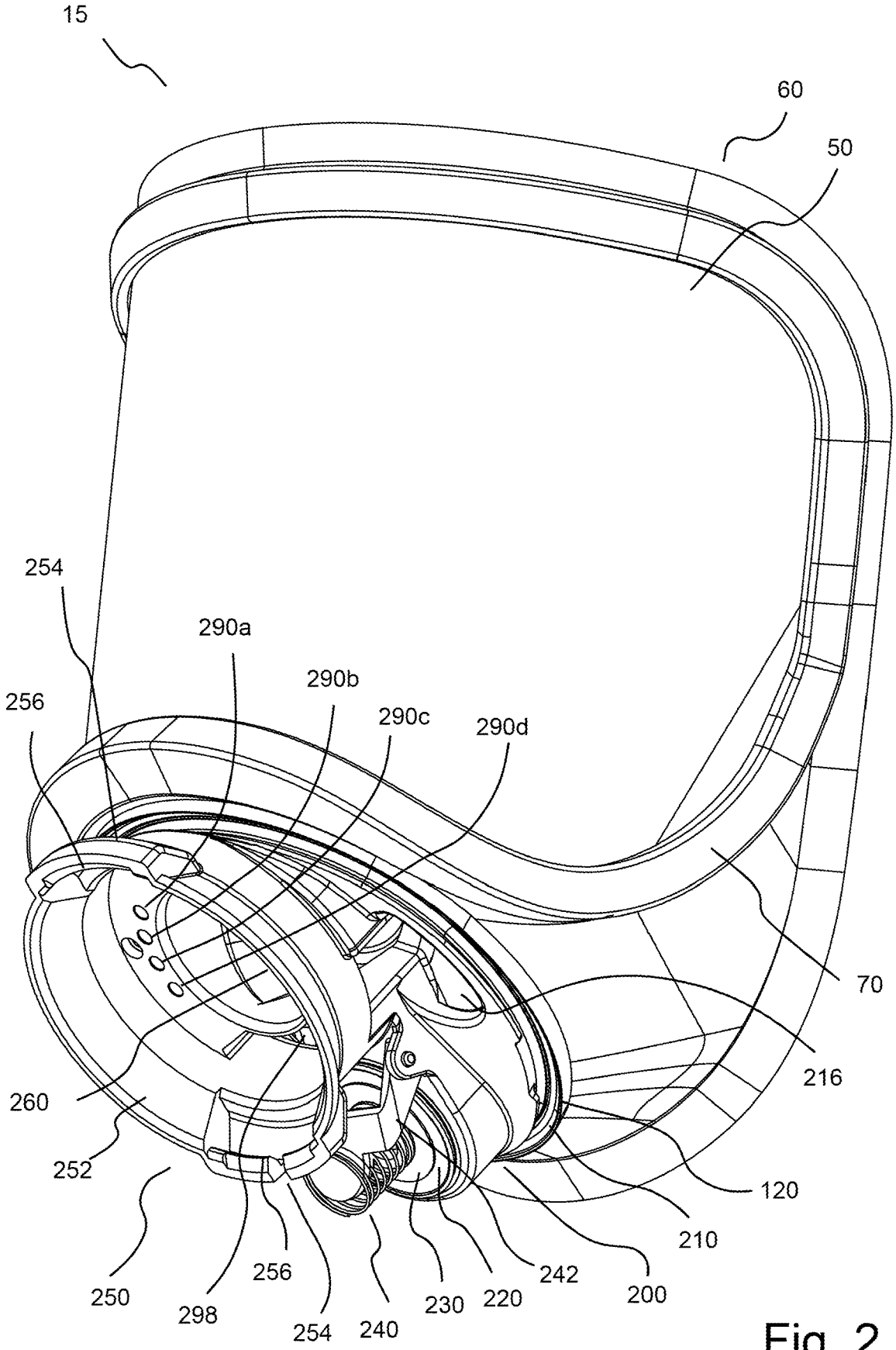
FIG. 2 illustrates a perspective view of a front section of the facepiece of FIG. 1.

As illustrated in FIG. 1, facepiece 10 may, for example, include a face blank 20 (fabricated, for example, from a silicon rubber) that includes a rear opening 30 which seals around the face of a user. In general, opening 30 includes a chin cupping section 32 that seals around the chin area of the user, side sections 34 that seal around the sides of the user's face and a forehead section (not shown in FIG. 1), opposite chin cupping section 32, that seals around the forehead of the user. Face blank 20 is sealingly attached to a forward section 15 (see, for example, FIG. 2) of facepiece 10, which includes lens 50 on an upper section thereof and respiration and/or filtering components formed in a lower section thereof. Face blank 20 may, for example, be sealingly attached to the forward section of facepiece 10 via a peripheral rim or edge 60.

As used herein in reference to facepiece 10 and other components, terms such as "front", "forward", "rear", rearward", "up", "down" or like terms refer generally to reference directions associated with a person wearing facepiece 10 and standing upright.

Facepiece 10 may, for example, have attached thereto an attachment section 380 which may be connected to, for example, strapping to attach facepiece 10 to the head of the user and to maintain face blank 20 of respirator mask 10 in sealing engagement with the face of the user.

Lens 50, through which the user views the surrounding environment, is attached to an upper portion of the front section 15 of facepiece 10 via a sealing rim 70. Respiration and/or filtering components are attached to front section 15 of facepiece 10 below lens 50. As illustrated, for example, in FIG. 1, facepiece 10 includes a generally central port or opening 100. Port 100 is formed in the forward end of an extending wall section 120 that extends forward from the remainder of the lower portion of front section 15.

A respirator component structure or housing 200 is attached to forward extending section 120. In that regard, housing 200 forms a sealed engagement, fit or connection with the internal wall of extending section 120. Housing, 200 may, for example, include a channel or groove 210 around the periphery thereof which forms a sealing engagement with the internal wall of extending section 120 (see, for example, FIG. 4A). Housing 200 may be of generally any shape to sealingly seat in a port of virtually any cooperating shape.

Figure 4A:
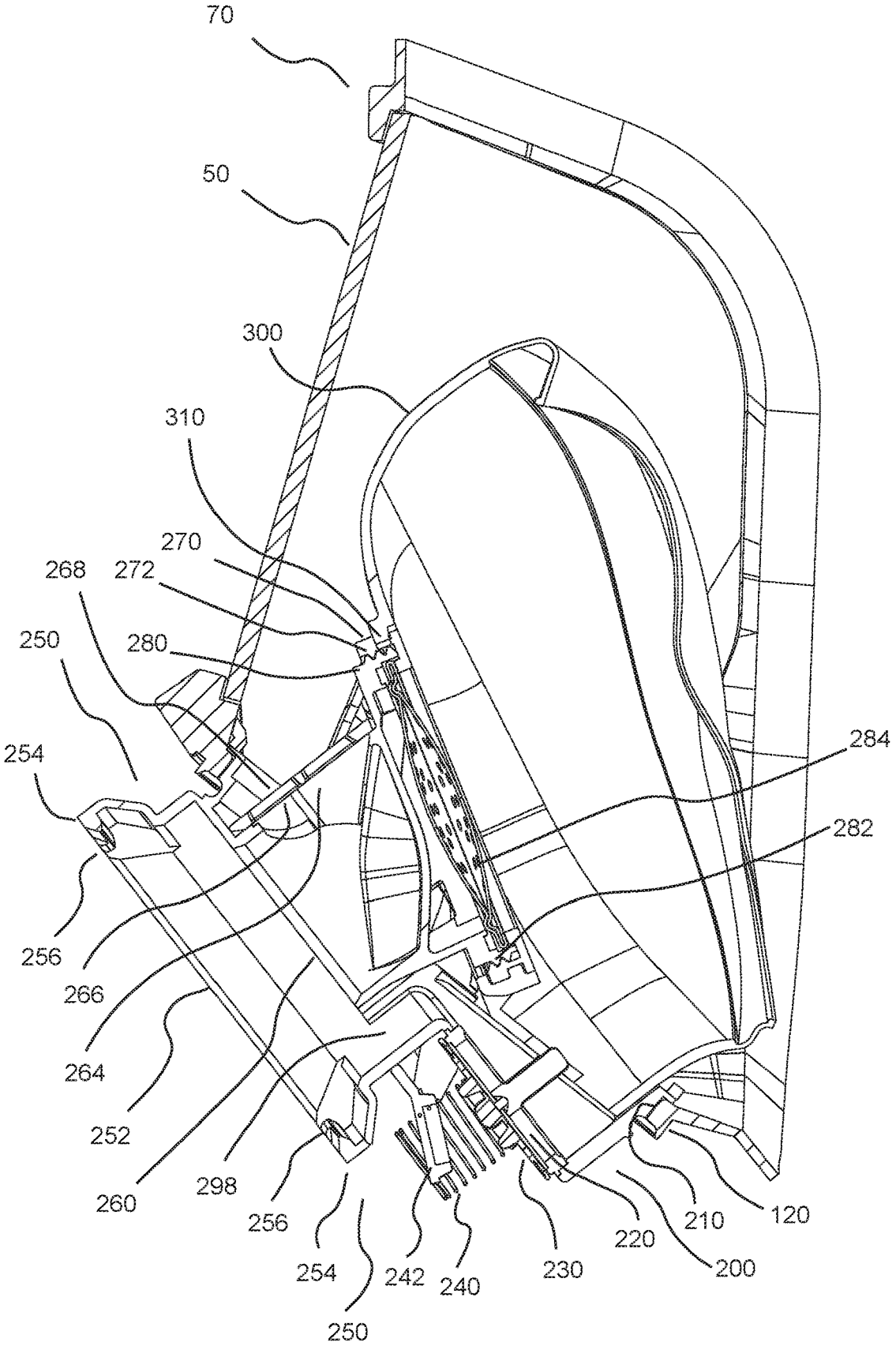
FIG. 4A illustrates a cross-sectional view of the front section of the facepiece.

Housing 200 also includes an exhalation port 220 (see, for example, FIG. 1) over which a sealing valve member 230 (for example, an umbrella valve member as known in the art; see, for example, FIG. 4A) is connected. In the illustrated embodiment, valve member 230 is biased in a closed position via, for example, a spring 240 (see, for example, FIG. 4A). Spring 240 is retained in connection with valve member 230 by a retainer 242. Biasing of valve member 230 results in a positive pressure within facepiece 10 as known in the art for operation in a pressure demand mode. Facepiece 10 can also be operated in a demand mode in which valve member 230 is not biased in a closed position. Valve 230 opens upon exhalation by a user of facepiece 10 but closes upon inspiration to prevent inspired air from passing through exhalation port 220.

An interface port 252 is formed in an interface portion of pressure regulator interface 250 of component housing 200 of facepiece 10 to place facepiece 10 in fluid connection with second stage pressure regulator 400 so that pressurized breathing gas (air or oxygen-containing gas) can be supplied from a pressurized air tank 500 via a first stage pressure regulator 502 (each of which are illustrated schematically in FIG. 1).

When connected to facepiece 10, pressure regulator 400 (illustrated, for example, in FIGS. 7A through 7E) delivers breathing gas to the user on demand. As known in the art, pressure regulator 400 may, for example, include a housing 401 within which is disposed a diaphragm 402 biased by a spring 404 that divides the regulator assembly into an inner chamber 406 in fluid connection with an interior of facepiece 10 and an outer chamber 408 in fluid connection with the surrounding environment, which is typically at ambient pressure (see FIG. 8A). Diaphragm 402 is coupled to an actuating mechanism 410 which opens and closes an inlet valve 412. The user's respiration creates a pressure differential between inner chamber 406 and outer chamber 408 of the regulator assembly 400 which, in turn, causes displacement of diaphragm 402 thereby controlling (that is, opening and closing) inlet valve 412 via mechanism 410. As a result, regulators such as regulator 400 are often called pressure demand regulators. An example of a pressure regulator operating in a similar manner to that described above to supply breathing gas to a user is the FIREHAWK® regulator available from Mine Safety Appliances Company of Pittsburgh, Pennsylvania.

Figure 7A:
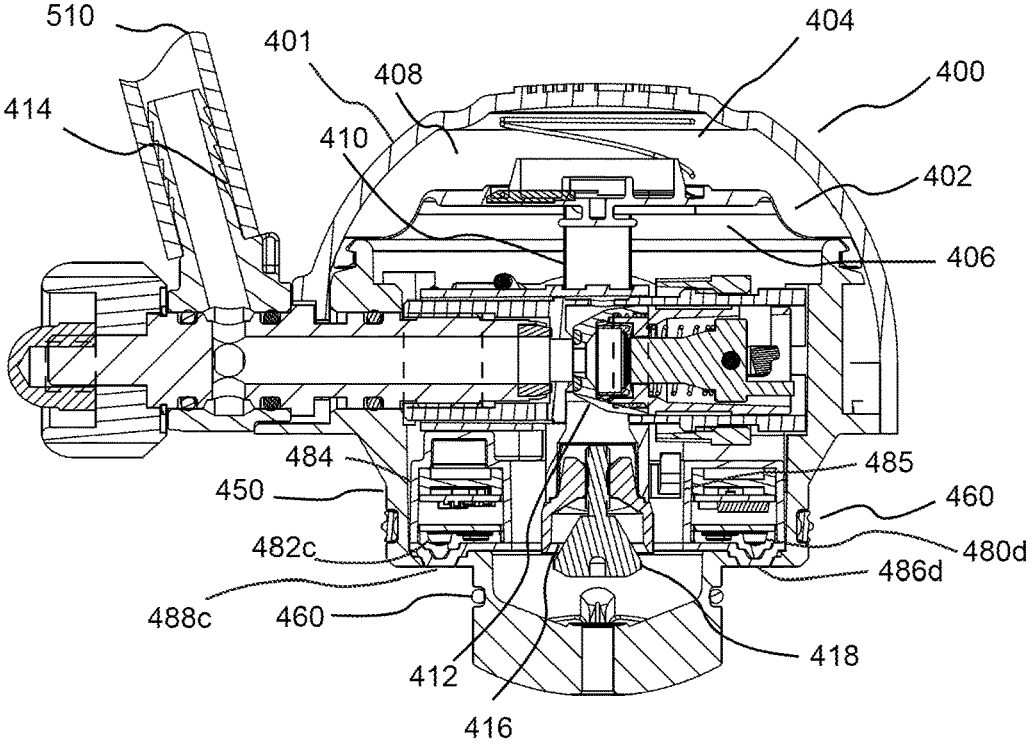
FIG. 7A illustrates a side, cross-sectional view of the pressure regulator.
Figure 7B:
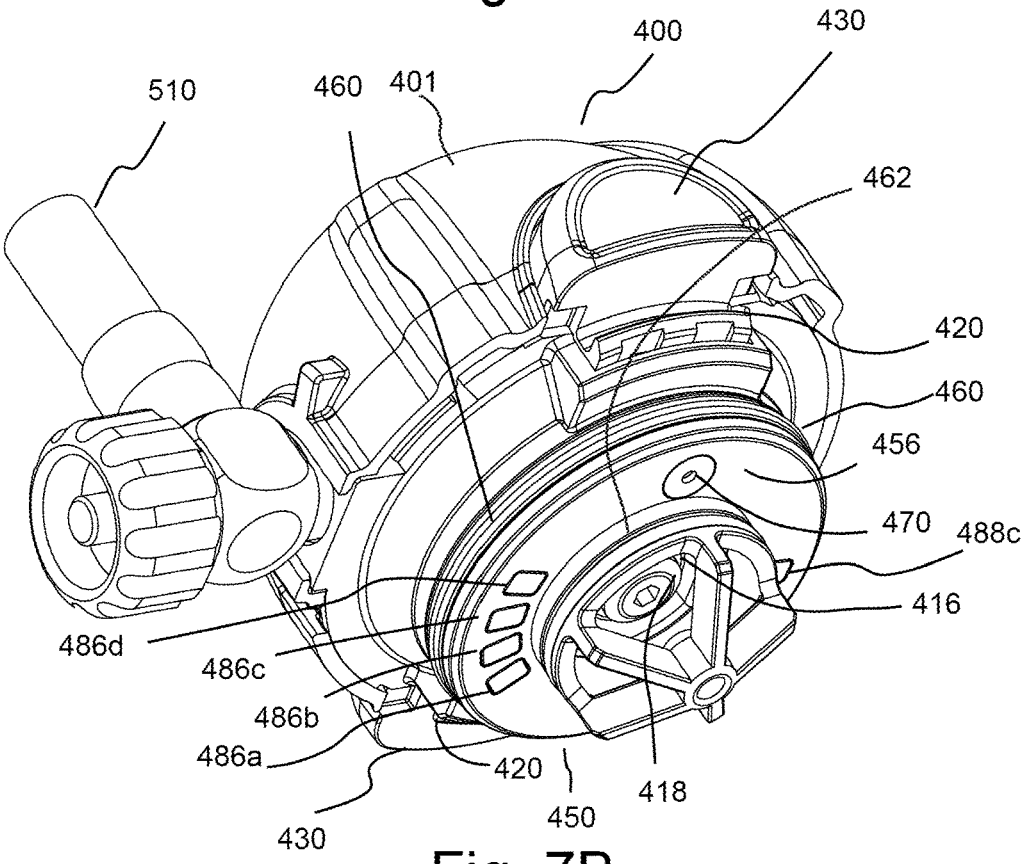
FIG. 7B illustrates a perspective view of the pressure regulator of FIG. 7A.
Figure 7C:
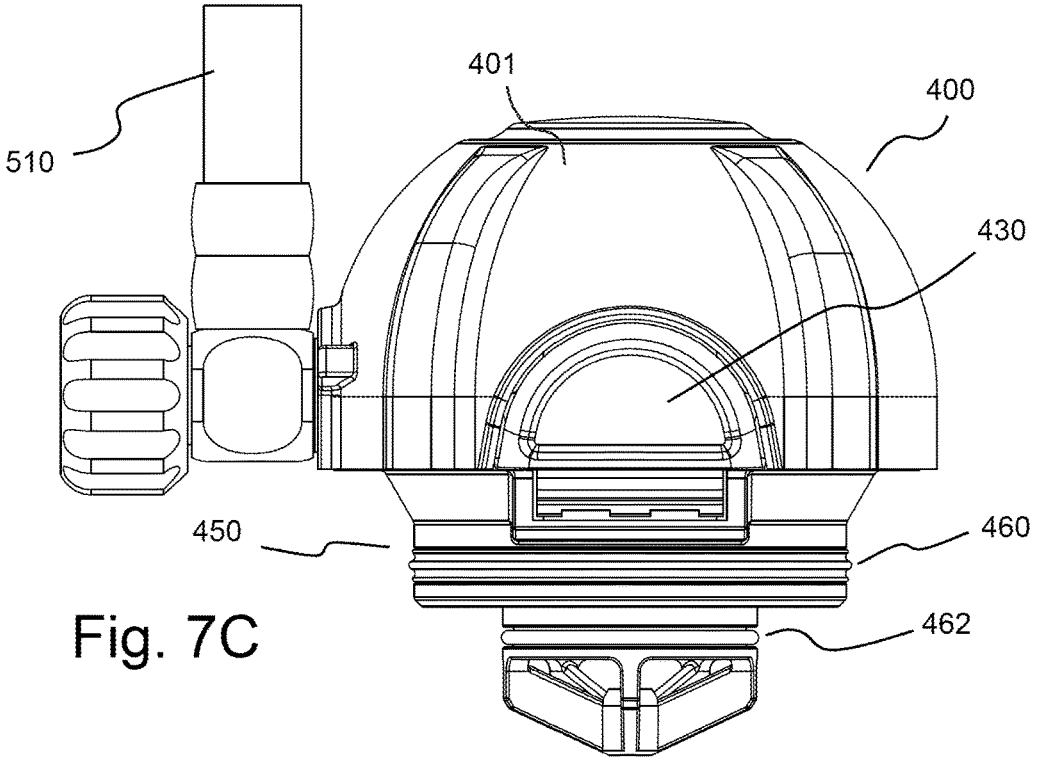
FIG. 7C illustrates a side view of the pressure regulator of FIG. 7A.
Figure 7D:
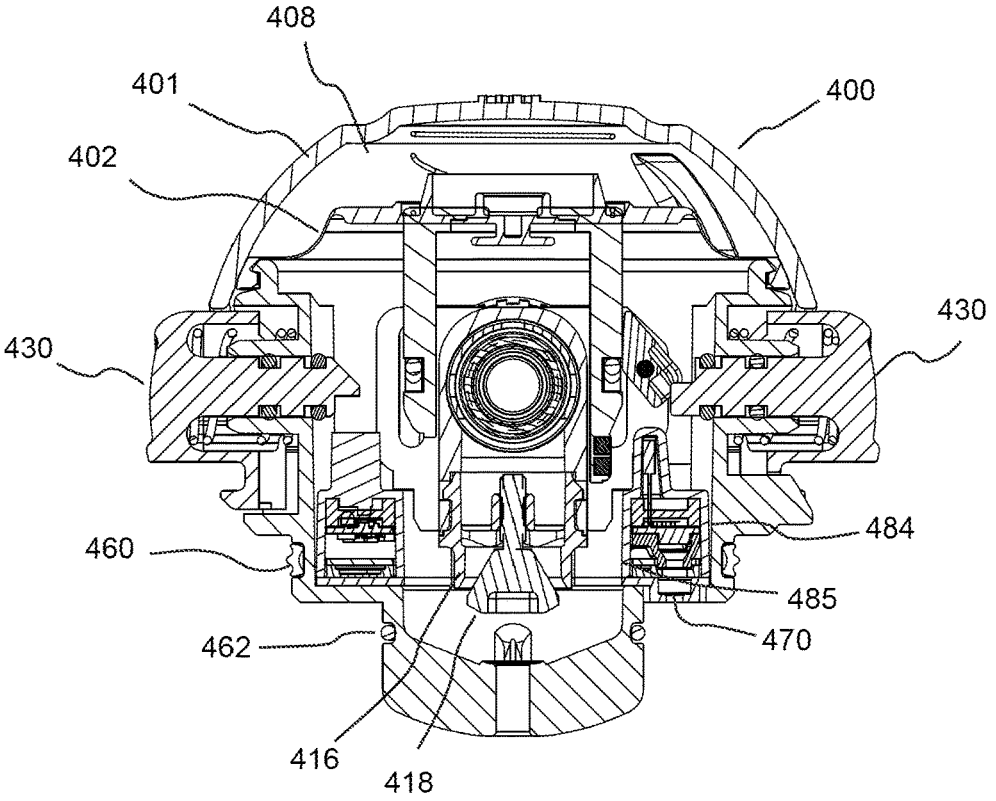
FIG. 7D illustrates another side, cross-sectional view of the pressure regulator of FIG. 7A.

As illustrated, for example, in FIG. 7A, an inlet 414 of regulator 400 may, for example, be connected to first stage pressure regulator 502 and thereby to pressurized air tank 500 via a flexible hose or other conduit 510. Inlet 414 may be a barbed inlet as known in the art for secure connection to hose 510. An outlet 416 is in fluid connection with valve 412. A flow adjustment mechanism 418 may, for example, be placed in connection with outlet 416 as known in the art.

In the illustrated embodiment, spring loaded retaining flanges 420 of pressure regulator 400 (see, for example, FIGS. 1 and 6) form a releasable connection with cooperating mounting flanges 256 of mounting interfaces 254 on the perimeter of interface port 252. Pressure regulator 400 includes release buttons 430 on each side thereof which can be depressed to release pressure regulator from connection with regulator port 252.

Figure 4B:
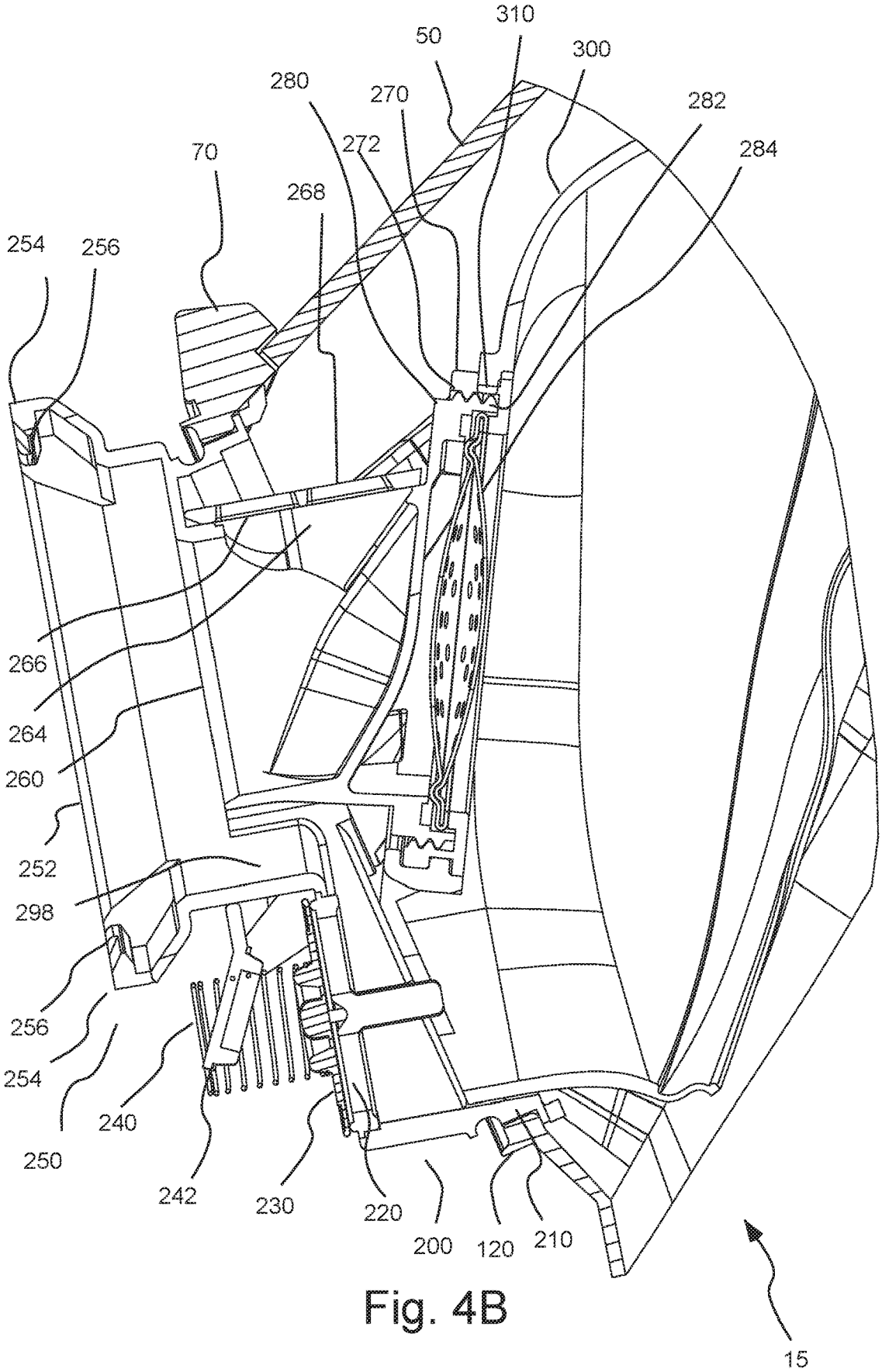
FIG. 4B illustrates an enlarged cross-sectional view of a portion of the front section of the facepiece.
Figure 5:
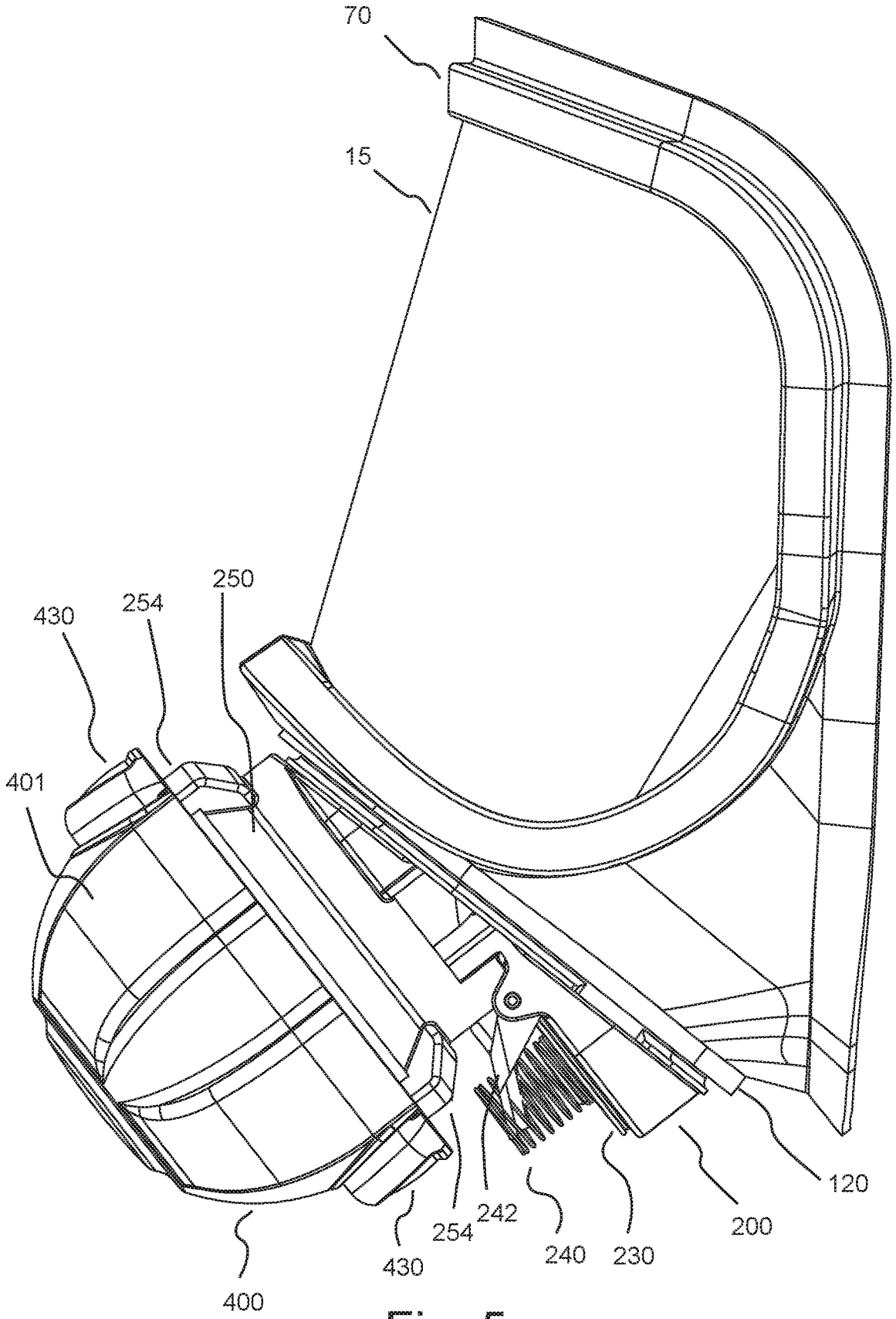
FIG. 5 illustrates a side view of the front section with an embodiment of a pressure regulator attached thereto.
Figure 6:
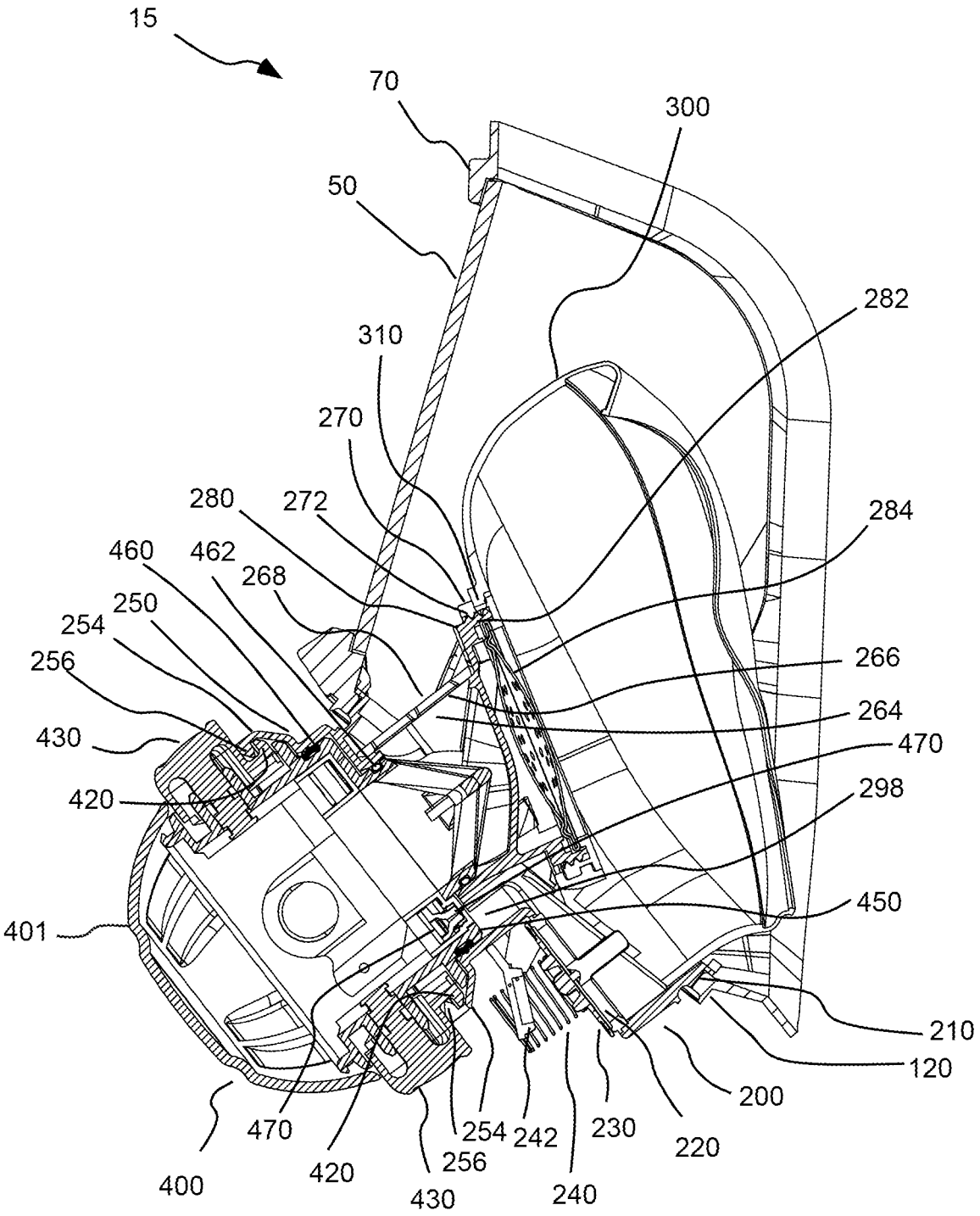
FIG. 6 illustrates a side, cross-sectional view of the front section and the pressure regulator, which is attached to the front section.

An inspiration or inhalation port 260 is in fluid connection with interface port 252 and provides an port for entry of, for example, pressurized air from pressure regulator 400 into the interior of facepiece 10 (see, for example, FIGS. 4A and 4B). In that regard, inhalation port 260 is in fluid connection with an inhalation check valve 264 including, for example, a valve seating 266 and a flexible flap valve 268. Inhalation valve 264 opens upon inhalation by a user of facepiece 10 but closes upon expiration to prevent expired air from passing through inhalation port 260. Contamination of pressure regulator 400 via inhalation port 260 during exhalation is thereby prevented.

In a number of embodiments, respirator mask 10 may, for example, also include a nose cup 300 that assists in directing the flow of air within respirator mask 10. Nose cup 300, which encompasses the nose and chin portion of the face, may, for example, be formed integrally from an elastomeric polymeric material such as an elastomer (for example, silicone). In the illustrated embodiment, nose cup 300 is attached to component housing 200 from the rear by, for example, extending or stretching a forward port or opening 310 of nose cup 300 around a flange 270 which is attached to component housing 200 via threading 272 on flange 270 and cooperating threading 282 on a rearward element 280 of component housing 200. Nose cup 300 may, for example, include one or more inhalation check valves 320. In the illustrated embodiment, a speech voicemitter 284 is positioned between port 310 and rearward element 282 to help provide intelligible speech transmittance through facepiece 10. In several embodiments, voicemitter 284 was formed from a thin film enclosed in a perforated aluminum housing.

Respirator mask or facepiece 10 also includes a housing cover 288 (see FIG. 1) that is removably attachable to component housing 200. Cover 288 may, for example, be injection molded as an integral part from a resilient polymeric material such as, for example, a polycarbonate, a polyester or a polycarbonate/polyester blend. Component housing 200 may, for example, be injection molded from a polymeric material in generally the same manner as cover 288. Likewise, lens 50 may, for example, be injection molded from a polymeric material (for example, a transparent polycarbonate).

Figure 3:
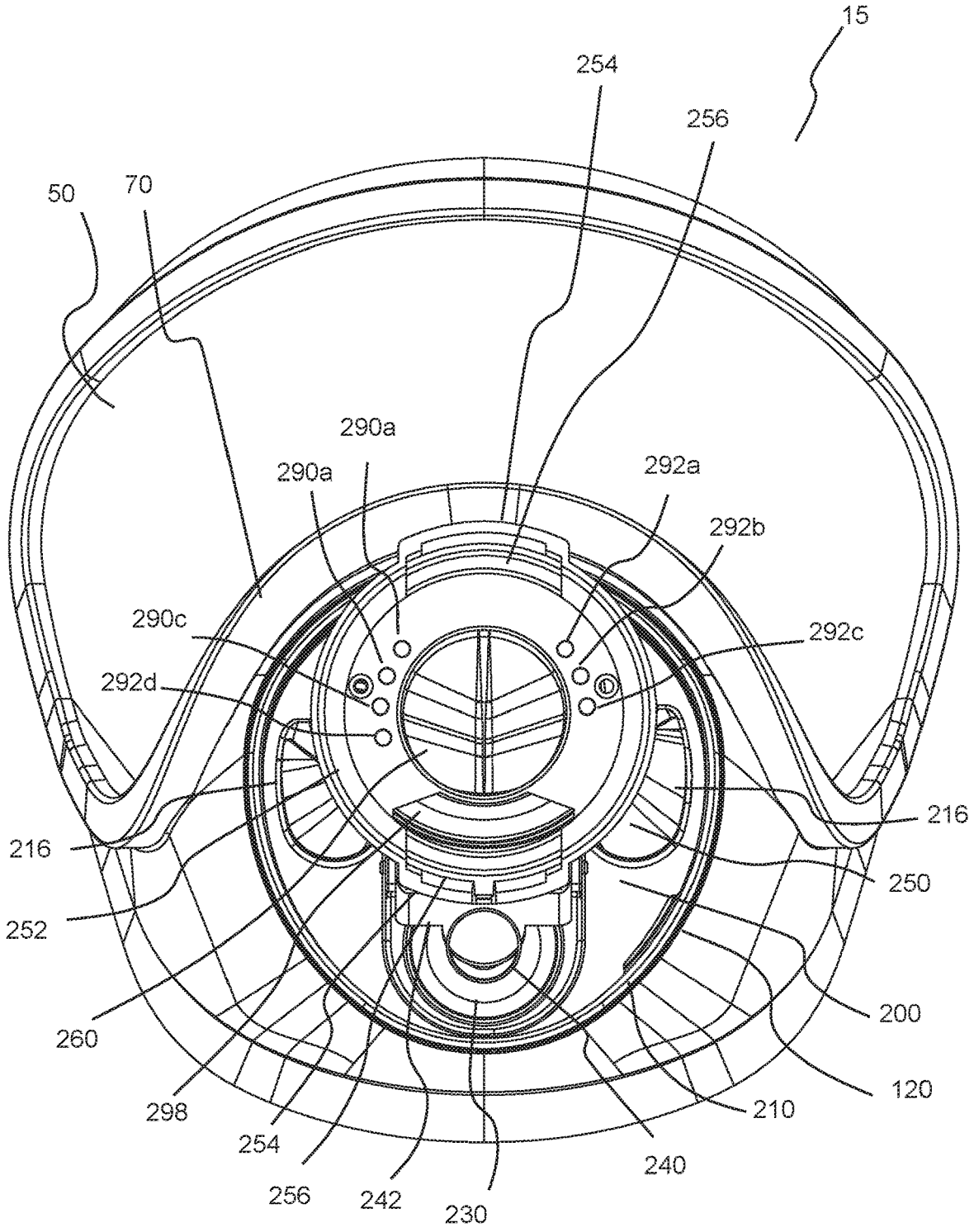
FIG. 3 illustrates another perspective view of the front section of the facepiece.

As, for example, illustrated in FIG. 3, an open, ambient or standby port 298 may be formed in interface 250 of component housing 200. Ambient port 298 is formed separately from inhalation port 260 and from exhalation port 220 and is in fluid connection with the interior of facepiece 10/nose cup 300 via a fluid pathway different from the fluid pathway connecting inhalation port 260 to the interior of facepiece 10/nose cup 300. In the illustrated embodiment, ambient port 298 is in fluid connection with an interior of facepiece 10/nose cup 300 such that there are no intervening check valves between ambient port 298 and the user's nose/mouth. The operation of ambient port 298 is described in copending U.S. Provisional Patent Application Ser. No. 61/360,935, entitled Facepiece With Open Port, filed of even date herewith, the disclosure of which is incorporated herein by reference.

Pressure regulator 400 includes at least one seal or sealing member 460 (for example, an elastomeric sealing member such as an elastomeric O-ring) that forms a sealing engagement with an inner wall of interface 250. Sealing member 460 seals that portion of interface 250 and that portion of pressure regulator 400 which are rearward of sealing member 460 from the external environment or ambient atmosphere. In the illustrated embodiment, pressure regulator 400 further includes a second seal or sealing member 462 (for example, an elastomeric sealing member such as an elastomeric O-ring) that forms a sealing engagement with an inner wall of interface 250.

In a number of embodiments, pressure regulator 400 may, for example, include or have connected thereto in the vicinity of a section or surface 456 (which may, for example, be generally adjacent to ambient port 298 upon connection of pressure regulator 400 to interface 250) a microphone 470 for transmission of the user's voice. Such positioning of microphone 470 provides a generally direct path between the user's mouth and microphone 470. Sealing member 460 provides a seal between microphone 470 and the ambient atmosphere. Pressure regulator 400 and sealing member 460 thereof protect microphone 470 from environmental elements such as dirt, dust, smoke, water and heat radiation that can damage microphone 470.

Figure 9B:
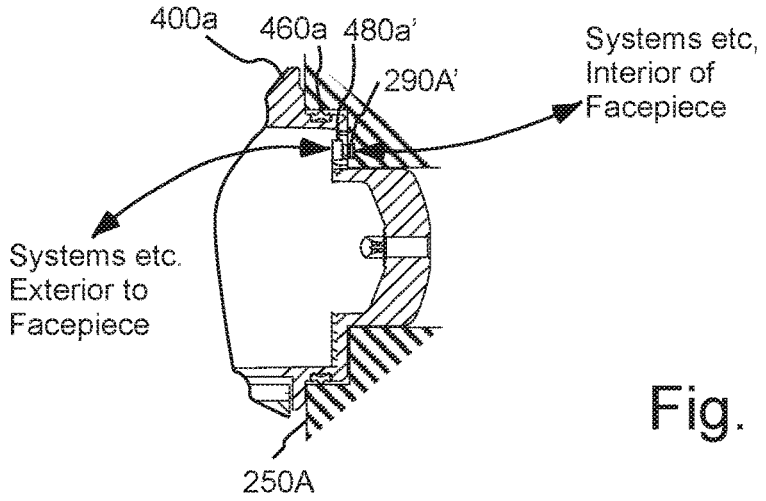
FIG. 9B illustrates sealing engagement of a pressure regulator with a pressure regulator interface of a facepiece and communicative connection of a transfer element of the pressure regulator with a cooperating transfer element of the pressure regulator interface.
Figure 9A:
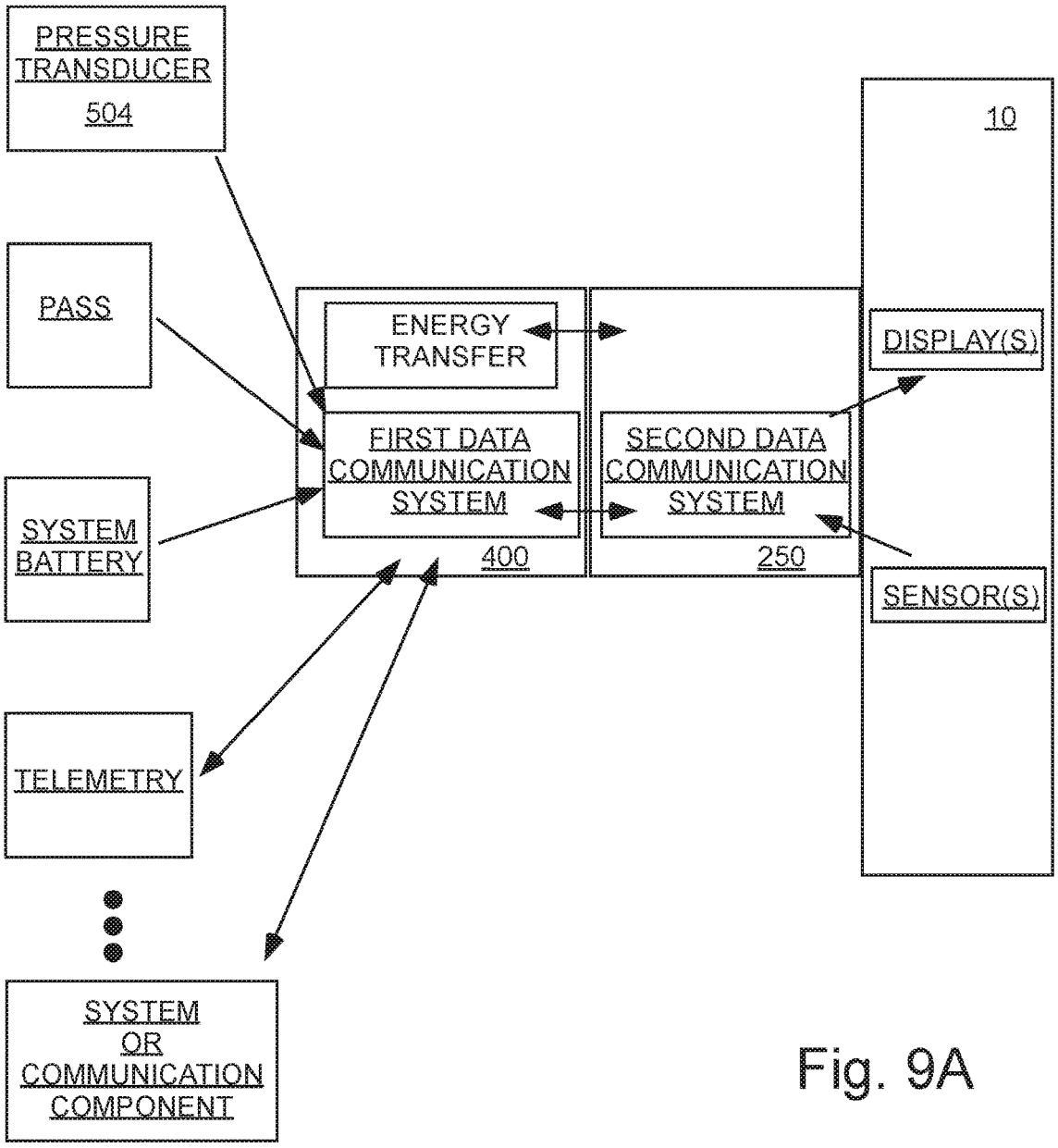
FIG. 9A illustrates a schematic representation of transmission of data/information from any number of devices or systems to, for example, one or more displays within the facepiece via a first data communication system within a pressure regulator and a second data communication system in operative connection with the pressure regulator interface of the facepiece.

In the illustrated embodiment, pressure regulator 400 also includes a first data communication system for transmitting information, data and/or signal between an interior of facepiece 10 and one or more systems and/or individuals exterior to facepiece 10 (see, for example, FIG. 9A). In a number of embodiments, the first data communication system communicates with, for example, a second data communication system within or in communicative connection with pressure regulator interface 250 of facepiece 10. The second data communication system may, for example, transfer or communicate the data to a user of facepiece 10 to be sensed by one or more of the user's senses (for example, visually, audibly, tactilely etc.)

Similar to microphone 470, communicating components of each of the first data communication system and the second communication system are positioned rearward of sealing member 460 when pressure regulator 400 is in operative connection with interface 250. The sealing engagement of sealing member 460 of pressure regulator 400 with pressure regulator interface port 252 protects the first and second data communication systems from environmental elements such as dirt, smoke, dust, water and heat that can damage or interfere with the operation of such systems. A number of components of the first data communication system may, for example, be internal to pressure regulator 400 such that housing 401 thereof provides protection from the surrounding environment. Communicative elements (for example, energy or signal transferring elements) of the first data communication system that communicate with cooperating communicative elements of the second data communication system may be positioned such that the seal between regulator 400 and pressure regulator interface 250 (upon connection of pressure regulator 400 thereto) provides protection from contamination or damage from environmental factors.

Transmission of data/information via the sealed connection between pressure regulator 400 and pressure regulator interface 250 eliminates the need to form an additional sealed passage into facepiece 10. The first data communication system may, for example, transmit information to facepiece 10 and the user thereof via interface port 252 of pressure regulator interface 250 in a manner that does not require a power source or other electronics within facepiece 10.

For example, in addition to the transfer of energy or signals for data transmission between the first communication system of pressure regulator 400 and the second communication system of pressure regulator interface 250, power or energy can be transferred between pressure regulator 400 and facepiece 10 via the connection of pressure regulator 400 and pressure regulator interface 250 (see, for example, FIG. 9A). Once again, energy transfer elements may be positioned such that the seal between regulator 400 and pressure regulator interface 250 provides protection from contamination or damage from environmental factors.

Energy for data transmission or energy for powering one or more components, for example, one or more displays, sensors etc., within facepiece may be transmitted in a wired or contacted manner or in a wireless or non-contacting manner. One or more sensors may, for example, be provided within facepiece 10 to monitor the status of the user. Transmission or transfer elements (for example, conductive contacts) on pressure regulator 400 or another pressure regulator may, for example, align with and contact cooperating transmission or transfer elements (for example, conductive contacts) on pressure regulator interface 250 or another pressure regulator interface. Likewise, energy for data transmission or for power may be transmitted in a wireless or non-contacting manner. For example, energy may be transferred via light energy, via microwaves or via induction. FIG. 913 illustrates schematically a portion of a pressure regulator 400*a* attached to a pressure regulator interface 250A such that a transfer element 480*a*' is positioned to transfer energy to and/or from a cooperating transfer element 290A' of pressure regulator interface 250A, Wherein a sealing member 460*a* provides protection from environmental factors.

Figure 7E:
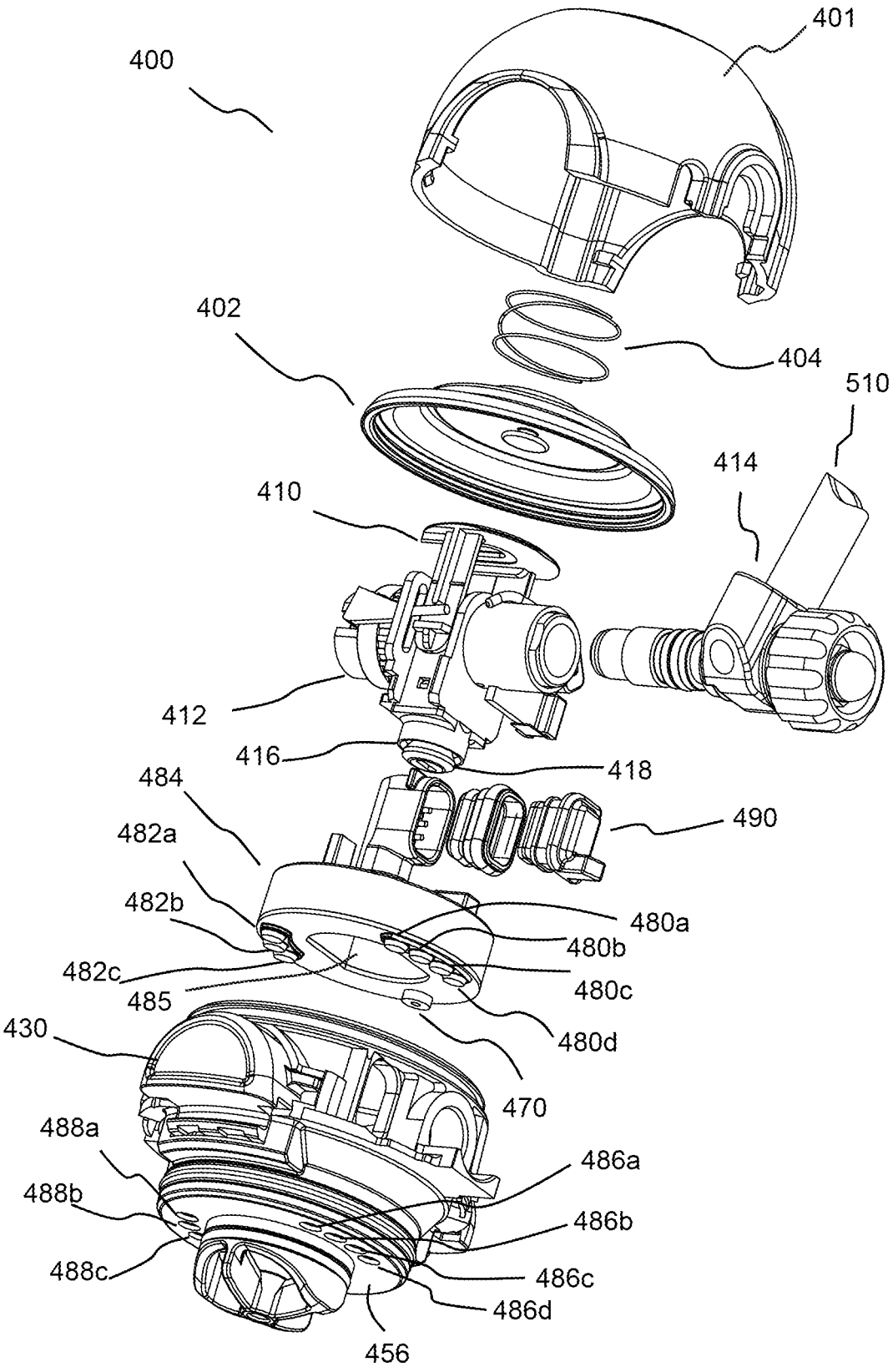
FIG. 7E illustrates a perspective view of the pressure regulator of FIG. 7A in an exploded or disassembled state.

In a number of embodiments in which, for example, light energy is used to transmit data/information to facepiece 10, there is no need to transfer power to facepiece 10 to power a display. For example, in the representative embodiment of pressure regulator 400 and facepiece 10, the first data communication system of pressure regulator 400 includes a transfer element including one or more light transmitters in the form of, for example, light emitting diodes (LEDs) 480*a*, 480*b*, 480*c*, 480*d*, 482*a*, 482*b* and 482*c*. As is clear to one skilled in the art, any number of light transmitters may be used. Light transmitters 480*a*, 480*b*, 480*c*, 480*d*, 482*a*, 482*b* and 482*c*, as well as microphone 470, may, for example, be attached to a printed circuit board assembly 484 within pressure regulator 400. As illustrated in FIG. 7E, printed circuit board assembly 484 may be formed in a generally annular shape, having a passage 485 therein, through which outlet 416 of pressure regulator 400 may be placed in fluid communication with inhalation port 260 of facepiece 10. When pressure regulator 400 is assembled, light transmitters 480*a*, 480*b*, 480*c*, 480*d*, 482*a*, 482*b* and 482*c* align with ports 486*a*, 486*b*, 486*c*, 486*d*, 488*a*, 488*b* and 488*c*, respectively, formed in rearward surface 456 of rearward extending section 450.

Upon attachment of pressure regulator 400 to pressure regulator interface port 252 of component housing 200, ports 486*a*, 486*b*, 486*c*, 486*d*, 488*a*, 488*b* and 488*c* (and thus light transmitters 480*a*, 480*b*, 480*c*, 480*d*, 482*a*, 482*b* and 482*c*) align with transfer elements including ports 290*a*, 290*b*, 290*c*, 290*d*, 292*a*, 292*b* and 292*c*, respectively, formed in pressure regulator interface 250. Pressure regulator 400 and pressure regulator interface port 252 may be "keyed" to ensure proper interconnection to align ports 486*a*, 486*b*, 486*c*, 486*d*, 488*a*, 488*b* and 488*c* with ports 290*a*, 290*b*, 290*c*, 290*d*, 292*a*, 292*b* and 292*c*, respectively. Retaining flanges 420 may, for example, be dimensioned differently so that pressure regulator 400 may be attached to pressure regulator interface port 252 in only one orientation.

Ports 290*a*, 290*b*, 290*c*, and 290*d* align with light guides or tubes 293*a*, 293*b*, 293*c* and 293*d*, respectively, of a light guide assembly 293 (see, for example, FIG. 1). Ports 292*a*, 292*b* and 292*c* align with light guides or tubes 294*a*, 294*b* and 294*c*, respectively, of a light guide assembly 294. As, for example, illustrated in FIG. 8B, rearward ends 293*a*', 293*b*', 293*c*', 293*d*', 294*a*', 294*b*' and 294*c*' of light guides 293*a*, 293*b*, 293*c*, 293*d*, 294*a*, 294*b* and 294*c* are positioned within the field of vision of the user of facepiece 10 to provide one or more displays to the user. Light guide assemblies 293 and 294 may be positioned within facepiece 10 in a manner to not interfere (or interfere only minimally) with the field of view of the user of the external environment (that is, the field of view through lens 50). Any interference with the external field of view may readily be minimized. In the illustrated embodiment, passages 216 may, for example, be formed in housing 200 of facepiece 10 through which light guide assemblies 293 and 294 can pass into the internal, sealed volume of facepiece 10.

In several embodiments, light guides or light tubes 293*a*, 293*b*, 293*c*, 293*d*, 294*a*, 294*b* and 294*c* were molded from a translucent thermoplastic material such as polycarbonate. Alternatively, fiber optic tubing, mirrored tubing or other light transmitting materials may be used.

In the illustrated embodiment, ports 486*a*, 486*b*, 486*c*, 486*d*, 488*a*, 488*b* and 488*c* and ports 290*a*, 290*b*, 290*c*, 290*d*, 292*a*, 292*b* and 292*c* are protected from the environment by the sealing interaction of sealing member 460 of pressure regulator 400 with pressure regulator interface port 252. No additional sealed passages are required to be formed in facepiece 10. In the case of use of facepiece 10 by, for example, a firefighter, the passage of air from tank 500 through pressure regulator 400 and pressure regular interface 250 operates to cool the data communications systems, preventing damage or interference from environmental heat.

In a number of embodiments, light sources 480*a*, 480*b*, 480*c* and 480*d* and corresponding light guides 293*a*, 293*b*, 293*c*, and 293*d* were used to transmit information on the status of breathing gas cylinder or tank 500 to the user. For example, in a number of embodiments, each of light sources 480*a*, 480*b*, 480*c* and 480*d* represented a one-quarter tank of breathing gas. In the case of a full tank, all of light sources 480*a*, 480*b*, 480*c* and 480*d* (and thereby light guides 293*a*, 293*b*, 293*c*, and 293*d*) are illuminated. In the case of a source or tank that is three-quarters full, only light sources 480*b*, 480*c* and 480*d* are illuminated. In the case of a tank that is one-half full, only light sources 480*c* and 480*d* are illuminated. In the case of a tank that is one-quarter full, only light source 480*d* are illuminated.

In a number of embodiments, light sources 482*a*, 482*b* and 482*c* and corresponding light guides 294*a*, 294*b*, 294*c* were used to transmit information regarding the status of a Personal Alert Safety System (or PASS, which automatically activates if the PASS does not detect motion of the user for a certain short period of time), the status of a system battery, and the existence of any evacuation alert, respectively.

Figure 8A:
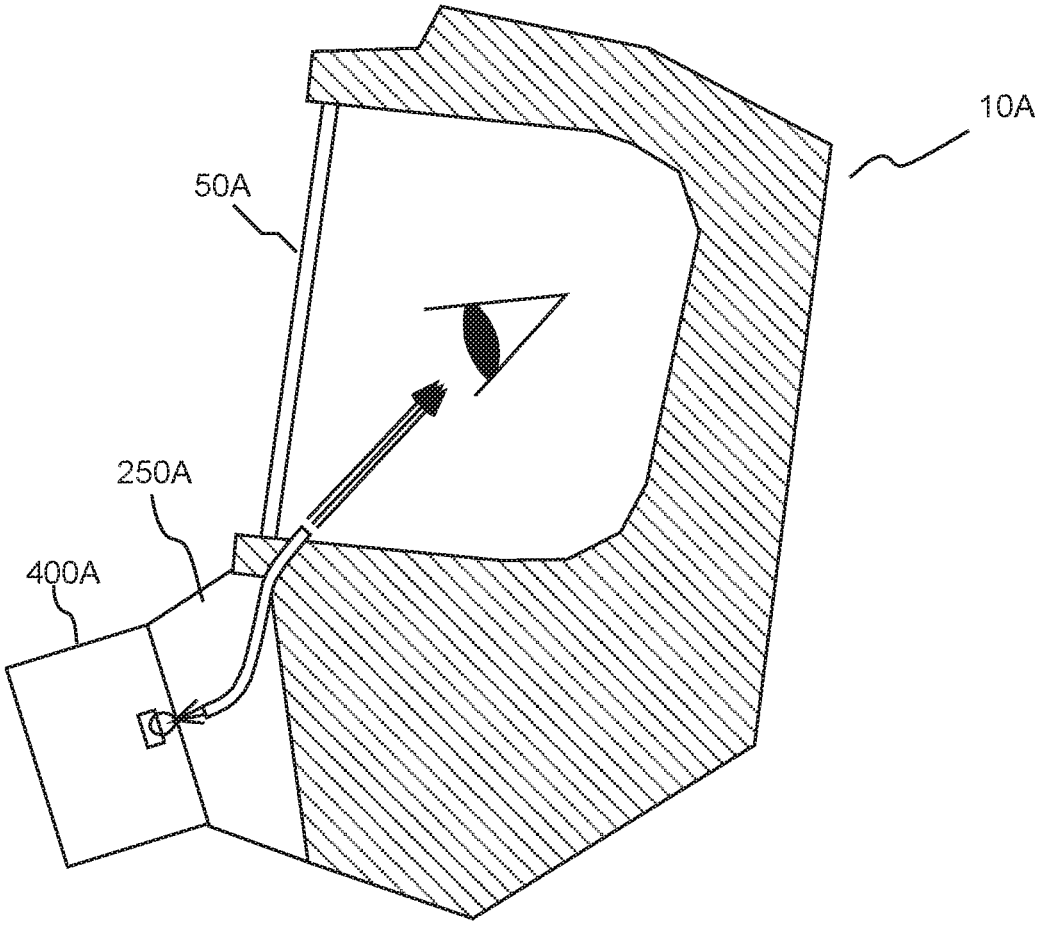
FIG. 8A illustrates a perspective view within the facepiece showing multiple displays to provide data/information to a user of the facepiece.
Figure 8B:
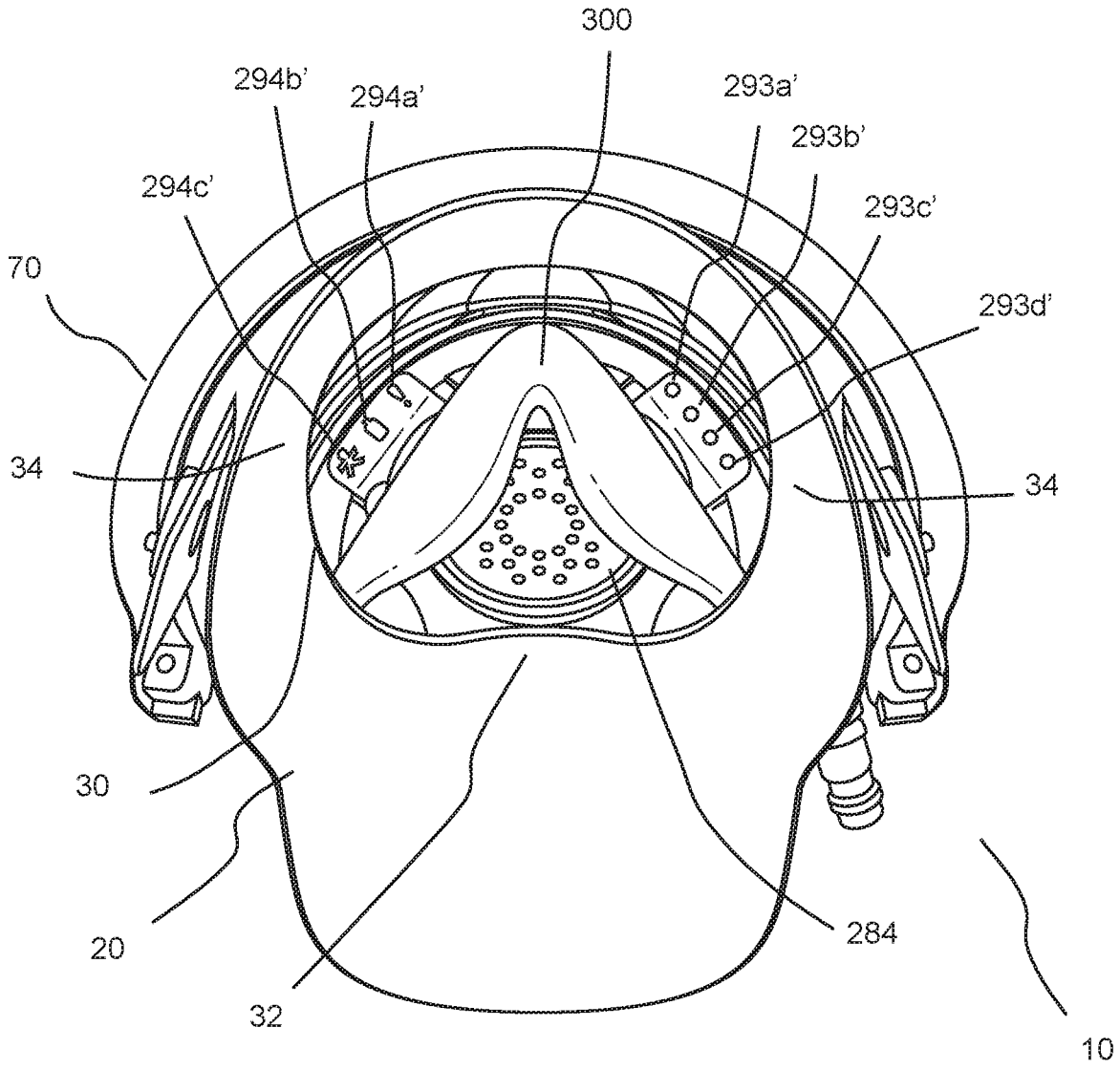
FIG. 8B illustrates a schematic representation of the transmission of a light signal to the eye of the user of the facepiece.

A simple on/off state of each of the light sources may, for example, be used to transmit information. Furthermore, color, modulation, frequency of modulation etc. may be used to convey additional information. Moreover, as illustrated in FIG. 8B, the shape of the rearward (viewable) ends of the light guides may be used to convey information or to clarify the transmission of information. In the embodiment of FIG. 8B, rearward ends 294*a*', 294*b*' and 294*c*' of of light guides 294*a*, 294*b* and 294*c* are uniquely shaped as symbols to convey information. The use of such symbols provides the user with a clear understanding of what a displayed light means, making interpretation of the information easier for the user and increasing the security of the user. Even well trained users can, for example, make errors or become insecure in their interpretation of information in highly stressful situations such as firefighting.

The first data communication system of pressure regulator 400 may receive data from various components including, but not limited to, a pressure transducer 504 in fluid connection with breathing gas tank 500, a PASS device, a system battery, a telemetry system in communicative connection with the user and/or any communication system in a wired or wireless manner as known in the communication arts (see, for example, FIG. 10). As, for example, illustrated in FIG. 7E, a communication module 490 may be in communicative connection with the first data communication system of pressure regulator 400. In the case of wired communication, one or more data or communication wires or cables may, for example, extend along or within flexible hose 510 to enter pressure regulator 400. As described above, the data/information received by the first data communication system of pressure regulator 400 may, for example, be transmitted to the second data communication system of pressure regulator interface 250, via which one or more displays within facepiece 10, which are within a field of view of the user of facepiece 10, are operated or controlled.

Using energy such as light energy to transmit data/information from a pressure regulator such as pressure regulator 400 or 200A to one or more viewable displays of such light energy within facepiece 10 or 10A (see. for example, FIG. 8A) eliminates the need for electronic components within facepiece 10, thereby eliminating costs, maintenance and weight associated with such electrical components.

In addition to or as an alternative to providing a display including the rearward ends of light guides as illustrated, for example, in FIG. 8B, such light guides may, for example, be used to project data/information onto a surface (for example, lens 50) within the field of view of the user of facepiece 10.

The foregoing description and accompanying drawings set forth embodiments. Various modifications, additions and alternative designs will, of course, become apparent to those skilled in the art in light of the foregoing teachings without departing from the scope hereof, which is indicated by the following claims rather than by the foregoing description. All changes and variations that fall within the meaning and range of equivalency of the claims are to be embraced within their scope.

What is claimed is:

1. A pressure regulator for use with a facepiece including a pressure regulator interface which provides a port of entry into the facepiece and includes at least one cooperating energy transfer element positioned within the pressure regulator interface, comprising:

a housing, a rearward extending section configured to form a removable, sealed connection with the pressure regulator interface;

an inlet for connection to a pressurized gas comprising oxygen, and at least one energy transfer element positioned on the pressure regulator that is configured to transfer energy between the at least one energy transfer element and the at least one cooperating energy transfer element and thereby between outside of the sealed connection and within the sealed connection when the pressure regulator is removably attached to the pressure regulator interface.

2. The pressure regulator of claim 1 wherein the at least one energy transfer element is configured to transfer electrical energy between the at least one energy transfer element and the at least one cooperating energy transfer element.

3. The pressure regulator of claim 1 wherein the at least one energy transfer element is configured to transfer light energy between the at least one energy transfer element and the at least one cooperating energy transfer element.

4. The pressure regulator of claim 1 wherein the at least one energy transfer element is in operative connection with a first data communication system and the at least one cooperating energy transfer element is in operative connection with a second data communication system.

5. The pressure regulator of claim 4 wherein the first data communication system is adapted to transmit display data to the second data communication system via transfer of energy between the at least one energy transfer element and the at least one cooperating energy transfer element.

6. The pressure regulator of claim 1 wherein the pressure regulator comprises at least one retaining flange configured to form a releasable connection with at least one mounting flange on the pressure regulator interface.

7. The pressure regulator of claim 6 further comprising a sealing member positioned on the rearward extending section to create the sealed connection between the pressure regulator and an inner wall of the pressure regulator interface when the pressure regulator is removably attached to the pressure regulator interface.

8. The pressure regulator of claim 7 wherein the at least one energy transfer element is positioned rearward of the sealing member.

9. The pressure regulator of claim 7 comprising a plurality of energy transfer elements positioned rearward of the sealing member, each of the plurality of energy transferring elements being aligned with one of a plurality of cooperating energy transfer elements of the facepiece when the pressure regulator is removably attached to the pressure regulator interface.

10. A facepiece, comprising:

at least one seal system to form a volume of sealing engagement with the face of a user to encompass the nose and mouth of the user;

a pressure regulator interface to which a pressure regulator is removably attachable to form a sealed connection between the pressure regulator interface and the pressure regulator, the pressure regulator interface providing a port of entry into the volume of sealing engagement, an inspiration port in fluid connection with the pressure regulator interface and in fluid connection with the interior of the facepiece; and at least one cooperating energy transfer element positioned within the pressure regulator interface and configured to transfer energy between the at least one cooperating energy transfer element and the pressure regulator and thereby between outside of the sealed connection and within the sealed connection when the pressure regulator is removably attached to the pressure regulator interface.

11. The facepiece of claim 10 wherein the at least one cooperating energy transfer is configured to transfer electrical energy between the at least one energy cooperating energy transfer element and at least one energy transfer element of the pressure regulator.

12. The facepiece of claim 10 wherein the at least one cooperating energy transfer element is configured to transfer light energy between the at least one energy cooperating energy transfer element and at least one energy transfer element of the pressure regulator.

13. The facepiece of claim 10 further comprising at least one display in communicative connection with the at least one cooperating energy transfer element, the display being positioned to be within the volume that is within the field of view of the user when the facepiece is worn by the user.

14. The facepiece of claim 10 wherein the at least one cooperating energy transfer is configured to transfer energy between the at least one energy cooperating energy transfer element and at least one energy transfer element of the pressure regulator, the at least one energy transfer element of the pressure regulator is in operative connection with a first data communication system and the at least one cooperating energy transfer element is in operative connection with a second data communication system.

15. The facepiece of claim 14 wherein the first data communication system is adapted to transmit display data to the second data communication system via transfer of energy between the at least one energy transfer element and the at least one cooperating energy transfer element.

16. The facepiece of claim 15 wherein the first data communication system comprises at least one light source and the second data communication system comprises at least one light guide.

17. The facepiece of claim 15 wherein the first data communication system comprises a plurality of light sources at spaced positions and the second data communication system comprises a plurality of light guides, each of the plurality of light sources being aligned to transmit light to a first end of one of the plurality of light guides when the pressure regulator is attached to the interface of the facepiece.

18. A facepiece, comprising:

at least one seal system to form a volume of sealing engagement with the face of a user to encompass the nose and mouth of the user;

a pressure regulator interface to which a pressure regulator is removably attachable to form a sealed connection between the pressure regulator interface and the pressure regulator, the pressure regulator interface providing a port of entry into the volume of sealing engagement, an inspiration port in fluid connection with the pressure regulator interface and in fluid connection with an interior of the facepiece; and at least one display positioned to be within the volume of sealing engagement with the face of the user that is within the field of view of the user when the facepiece is worn by the user, the at least one display comprising at least one light port in operative connection with at least one light guide, the at least one light guide being configured to receive light energy transmitted from the pressure regulator via the sealed connection between the pressure regulator interface and the pressure regulator.

19. The facepiece of claim 18 wherein the at least one display comprises a plurality of light ports, each of the plurality of light ports being in operative connection with one of a plurality of light guides, each of the plurality of light guides being configured to receive light energy transmitted from the pressure regulator via the sealed connection between the pressure regulator interface and the pressure regulator.

* * * * *